United States Patent [19]

Hanpeter et al.

[11] Patent Number: 4,616,316

[45] Date of Patent: Oct. 7, 1986

[54] MEDICATION COMPLIANCE MONITORING DEVICE HAVING CONDUCTIVE TRACES UPON A FRANGIBLE BACKING OF A MEDICATION COMPARTMENT

[75] Inventors: John A. Hanpeter; Seth A. Eisen, both of St. Louis, Mo.; Michael F. Gard, Catoosa, Okla.

[73] Assignee: The United States of America as represented by the Administrator of Veterans Affairs, Washington, D.C.

[21] Appl. No.: 458,312

[22] Filed: Jan. 13, 1983

Related U.S. Application Data

[63] Continuation-in-part of Ser. No. 394,432, Jul. 1, 1982, abandoned.

[51] Int. Cl.[4] ..... G07F 9/02; G04F 1/00; B65D 85/56

[52] U.S. Cl. ..... 364/413; 206/531; 206/534; 221/2; 221/5; 221/302; 339/80; 364/479; 364/569; 340/303

[58] Field of Search ..... 364/705, 413, 479, 569; 206/531, 532, 534; 235/98 A, 98 B; 340/303; 221/2, 3, 4, 5, 8, 15, 25, 26, 302; 339/80

[56] References Cited

U.S. PATENT DOCUMENTS

| | | | |
|---|---|---|---|
| 2,921,152 | 1/1960 | Simjian | 339/80 X |
| 3,136,842 | 6/1964 | Perkins et al. | 339/80 X |
| 3,332,575 | 7/1967 | Pilot et al. | 221/8 |
| 3,344,951 | 10/1967 | Gervais | 221/7 |
| 3,402,850 | 9/1968 | Barton et al. | 221/8 |
| 3,410,450 | 11/1968 | Fortenberry | 221/7 |
| 3,511,409 | 5/1970 | Huck | 221/7 |
| 3,687,336 | 8/1972 | Gayle | 221/7 |
| 3,688,945 | 9/1972 | Harman, Jr. et al. | 221/8 |
| 3,749,279 | 7/1973 | Ungerman | 221/7 |
| 3,871,551 | 3/1975 | Bender | 221/8 |
| 4,125,871 | 11/1978 | Martin | 364/900 |
| 4,300,207 | 11/1981 | Eivers et al. | 364/900 |
| 4,360,125 | 11/1982 | Martindale et al. | 364/479 X |
| 4,366,481 | 12/1982 | Main et al. | 340/825.54 |
| 4,372,464 | 2/1983 | Otten | 221/14 |
| 4,419,616 | 12/1983 | Baskins et al. | 320/2 |
| 4,429,792 | 2/1984 | Machbitz | 206/532 X |

OTHER PUBLICATIONS

H&R Corp. Product Catalog, vol. 51, No. 2, Mar.–Apr. 1985, 4.

*Primary Examiner*—Jerry Smith
*Assistant Examiner*—Clark A. Jablon
*Attorney, Agent, or Firm*—Browdy and Neimark

[57] ABSTRACT

A medication compliance monitoring system consisting of a blister pack having an array of plastic blisters defining compartments for medication, with a frangible non-conductive backing sheet having conductive traces behind the compartments which are respectively ruptured when the medication doses are removed. The blister pack is detachably connected to an electronic memory circuit via a multi-terminal male connector tab on the backing sheet, wired to the conductive traces, and a corresponding female connector with terminals wired to the electronic memory circuit. The electronic memory circuit addresses each individual trace periodically at a constant time interval over a predetermined extended period of time to determine if it is intact. The electronic memory circuit detects the ruptures and stores the time data thereof over said extended period of time. During the patient's follow-up visit a microcomputer is employed to retrieve the dose-removal-time data from the memory circuit; it processes the data and provides a display of the compliance information. A socket adapter is used to alternately configure the electronic memory circuit for data acquisition and extraction. The socket adapter is in the form of a multiple-pin jumper plug engageable in a multi-contact socket connected to the memory circuit. Insertion of the plug configures the memory circuit for data acquisition. Removal of the plug configures the memory circuit for data retrieval and processing by the microcomputer. In a typical embodiment there are 42 blisters whose associated conductive traces are addressed every 15 minutes over an extended time period which may be as much as 85 days.

18 Claims, 10 Drawing Figures

MEDICATION COMPLIANCE MONITORING DEVICE HAVING CONDUCTIVE TRACES UPON A FRANGIBLE BACKING OF A MEDICATION COMPARTMENT

The present application is a continuation-in-part of the patent application of John A. Hanpeter, Jr., Seth A. Eisen and Michael F. Gard, Ser. No. 394,432, filed July 1, 1982, and now abandoned, entitled "Medication Compliance Monitoring Device", the contents of which are incorporated herein by reference.

FIELD OF THE INVENTION

This invention relates to medication dispensers, and more particularly to a device for providing detailed information on patient medication compliance.

BACKGROUND OF THE INVENTION

Poor compliance with the physician-prescribed medication regimen is a major cause of disease-related morbidity and mortality. For example, hypertension, which affects 60 million Americans, is a significant risk factor for stroke, heart and kidney diseases. Research has demonstrated that hypertension can be controlled in the vast majority of patients with currently available medications if patients adhere to the prescribed regimen at least 80% of the time. Unfortunately, many patients are not compliant with their medications and therefore are at increased risk of complicating illnesses. The lack of a satisfactory method of measuring medication compliance has hindered the assessment of attempts to improve compliance as well as research which might increase our understanding of poor compliance.

Various previously proposed devices for testing compliance of patients with prescribed medication regimens have proven to be unsatisfactory in that they are relatively cumbersome, are not accurate, and do not adequately cover the extended time spans for which many prescribed dosing regimens must be maintained.

In general, the prior art includes a number of mechanical devices for indicating the timed removal of pills from various holders or dispensers. For example, the Fortenberry U.S. Pat. No. 3,410,450 discloses a sanitary pill dispenser with an indicator dial to indicate release of each successive pill. Also see the Bender U.S. Pat. No. 3,871,551 which shows a pill dispenser with a pill-actuated time readout. Barton et al U.S. Pat. No. 3,402,850 discloses a tablet dispenser with a day-indicating schedule.

The patent to Gervais U.S. Pat. No. 3,344,951 shows an injection pill dispenser which incorporates a mechanical device for recording of times of pill removal under prescribed conditions. The Pilot U.S. Pat. No. 3,332,575 shows another dispenser with an indicating means, which indicator gives the day each pill is dispensed. Harman et al U.S. Pat. No. 3,688,945 shows another mechanical tablet dispenser, for contraceptive pills, with a time indicator. The Gayle U.S. Pat. No. 3,687,336 shows another mechanical device which ejects pills in synchronization with day indicating means. And Huck U.S. Pat. No. 3,511,409 shows another mechanical dispenser with a day indicator for pill usage.

Accordingly, there is a definite need for an improved device for measuring the compliance of patients with physician-prescribed medication regimens.

SUMMARY OF THE INVENTION

A medication compliance monitoring system according to the present invention has three functional components: the blister pack, the electronic memory circuit, and a microcomputer data processor. In a typical embodiment, the blister pack consists of a sheet of plastic into which 42 blisters are formed, and a sheet of backing material. The patient's tablets or capsules are loaded into the blisters and the backing material is sealed to the blister sheet. A matrix of conductive traces is incorporated into the backing material such that a unique trace is positioned behind each blister in the pack. When the medication dose is pressed through the backing material, the conductive trace behind that dose is broken. The electronic memory circuit addresses each individual trace every 15 minutes to determine if it is intact. The time of removal, resolved into 15 minute intervals with less than 0.01% error, is stored in memory for each individual dose over an 85 day period. A protective plastic case (50 mm×170 mm×30 mm) contains both the memory circuit and the fold-out blister pack. The total weight is approximately 100 grams. Thus, the device is small and lightweight and thus of a size and weight suitble for personal use and can be conveniently carried by the patient in his or her pocket, briefcase, or handbag.

In practice, the blister pack is loaded with the appropriate medication and connected to the memory circuit in the case, the memory circuit is initialized, and the device is issued to the patient. The patient carries it with him or her and returns it to the physician on his or her next visit. During the patient's follow-up visit, the memory circuit is interfaced to the microcomputer data processor. This system acquires the raw time data from the memory circuit, stores the raw data on a diskette, processes the data, and provides the medication compliance data to the physician in a graphically formatted printout. The physician utilizes the data to analyze the patterns of the patient's non-compliance and then works with the patient to develop a more acceptable medication regimen.

Accordingly, objects of the invention are to provide a novel and improved patient medication compliance device which overcomes the deficiencies and disadvantages of the previously known dosage monitoring systems, and to provide for improved patient medication compliance and/or monitoring.

A further object of the invention is to provide an improved medication compliance monitoring device which is compact in size, light in weight, accurately records the time of removal of medication doses over a dosage regimen which may extend for a relatively long period of time, addresses the dosage locations at uniformly regular, relatively short intervals of the order of every 15 minutes, to determine whether the medication doses originally placed therein are intact, and which stores the respective times of removal of the doses in a memory for subsequent analysis by medical personnel to determine the pattern of medication compliance of the patient.

A still further object of the invention is to provide an improved medication compliance monitoring device which may be furnished to a patient by a physician and which employs a blister pack loaded with appropriate medication in the form of tablets, capsules, or the like, arranged in respective compartments, each compartment being provided in its back wall with a conductive trace which is broken when the associated medication unit is removed and which is repetitively tested for integrity by an electronic memory circuit in the device, the memory circuit storing data corresponding to the detection of the broken traces, which is time data giving the time of removal of the respective medication doses, the stored data being retrievable when the patient returns the device to the physician at his next visit, so that the pattern of the patient's medication compliance can be readily analyzed by the physician by interfacing the memory circuit with a microcomputer data processor.

A still further object of the invention is to provide an improved medication compliance monitoring device including a blister pack carrying medication arranged in compartments with conductive traces which are broken when the associated medication doses are removed, and which are monitored by an electronic memory circuit, the memory circuit being contained in a compact carrying case and the blister pack being normally folded so as to be housed in the case along with the electronic monitoring and memory circuit, the blister pack being detachably connected to the electronic memory circuit but being detachable therefrom, by disengageable connector means so that the case and electronic circuit can be reused with a new blister pack after a first pack has been employed for a medication regimen.

BRIEF DESCRIPTION OF THE DRAWINGS

Further objects and advantages of the invention will become apparent from the following description and claims, and from the accompanying drawings, wherein:

DETAILED DESCRIPTION OF A PREFERRED EMBODIMENT

Figure 1:
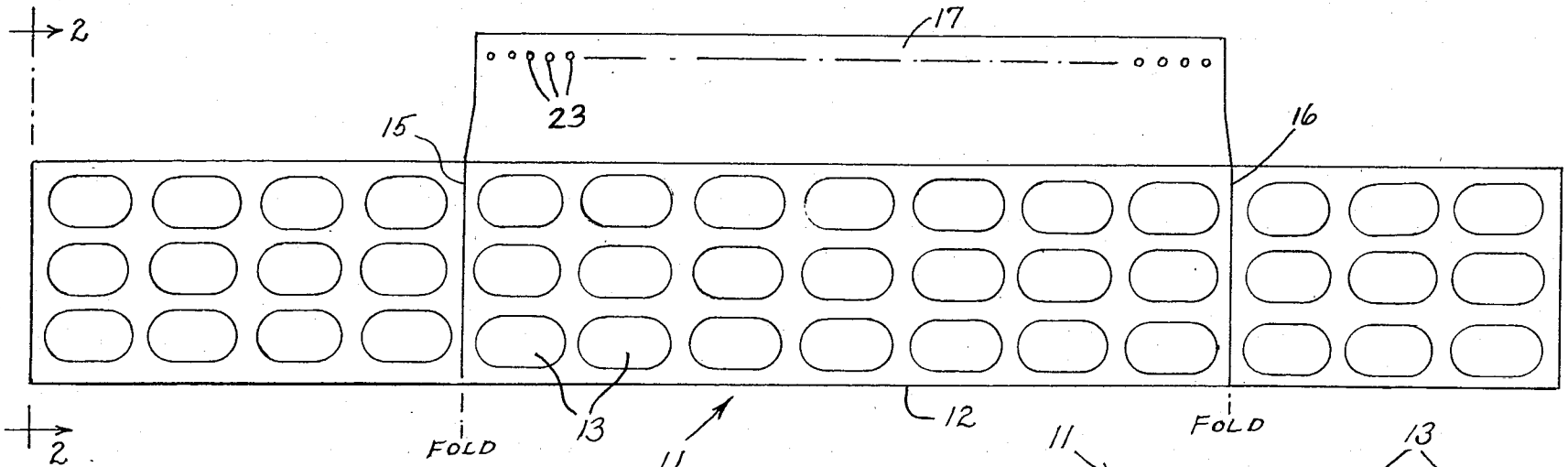
FIG. 1 is a top plan view of a blister pack employed in the medication compliance monitoring system according to the present invention, shown in unfolded condition.
Figure 2:
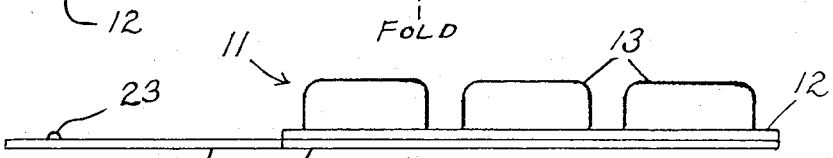
FIG. 2 is an enlarged end elevational view taken substantially on line 2—2 of FIG. 1.
Figure 3:
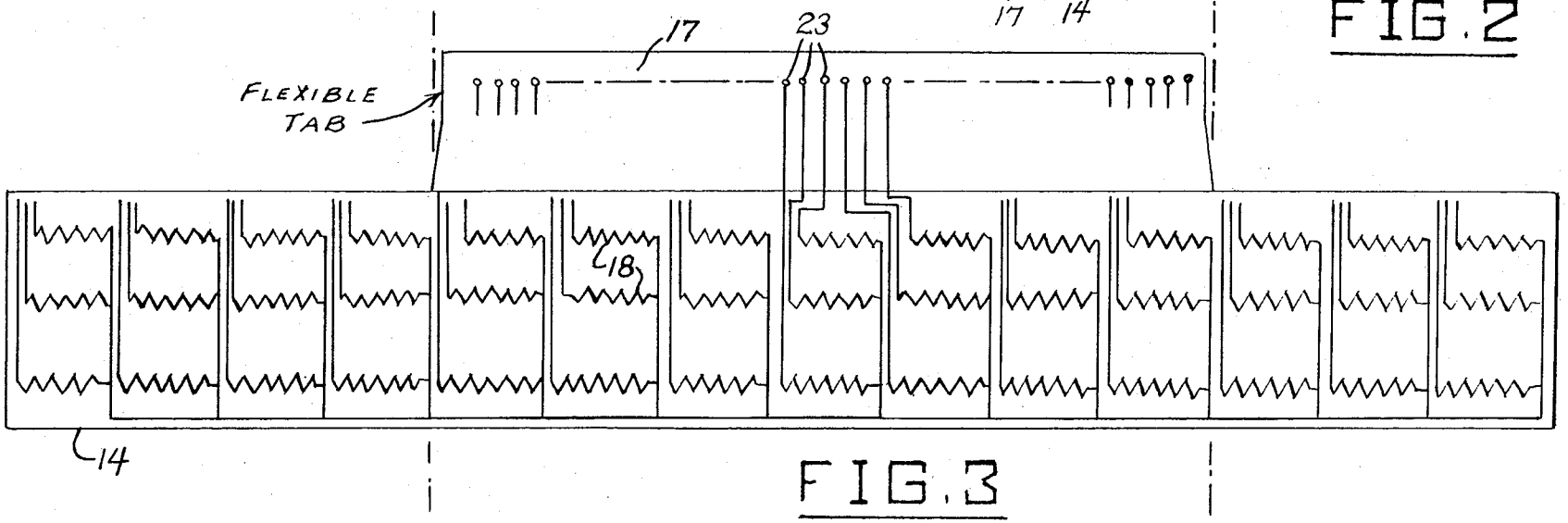
FIG. 3 is a partly diagrammatic top plan view of the backing sheet employed in the blister pack of FIG. 1.

Referring to the drawings, and more particularly to FIGS. 1 to 5, 11 generally designates a blister pack forming part of the present invention. The blister pack 11 is that portion of the device which contains the patient medication. The blister pack 11 comprises a sheet 12 of plastic material in which an array of blisters 13 is formed, and a sheet 14 of insulating backing material. The patient medication is loaded into the blisters 13 and the backing sheet 14 is sealed to the blister sheet 12 by a layer of suitable adhesive.

In the illustrated specific embodiment, the blister pack 11 of FIGS. 1 to 5 contains 42 blisters 13 in an array of 3 rows of 14 blisters on 3 panels that fold back-to-back on respective transverse fold lines 15 and 16. Each blister 13 is generally oval-shaped, with a major axis of 22 mm, a minor axis of 13.5 mm, and a depth of 9 mm. The blister pack 11 is connected to the electronic memory board, designated generally at 19 in FIGS. 4 and 5, via a multiple-contact, flexible connector tab 17 formed on sheet 14 and extending along the center panel of the blister pack.

The backing sheet 14 used to seal the blisters 13 is of a special nature. Said sheet 14 is formed of thin frangible insulating material. A matrix of sawtooth-shaped conductive traces 18 is incorporated into the backing material, arranged so that a unique conductive trace 18 is positioned behind each blister 13 in the blister pack 11. While the dose is still present in a blister 13, the associated trace 18 behind that blister remains intact. When the dose is pressed through the backing material however, the trace 18 is broken. The electronic memory device 19 addresses and tests each individual trace periodically to determine whether or not the trace is intact.

Figure 4:
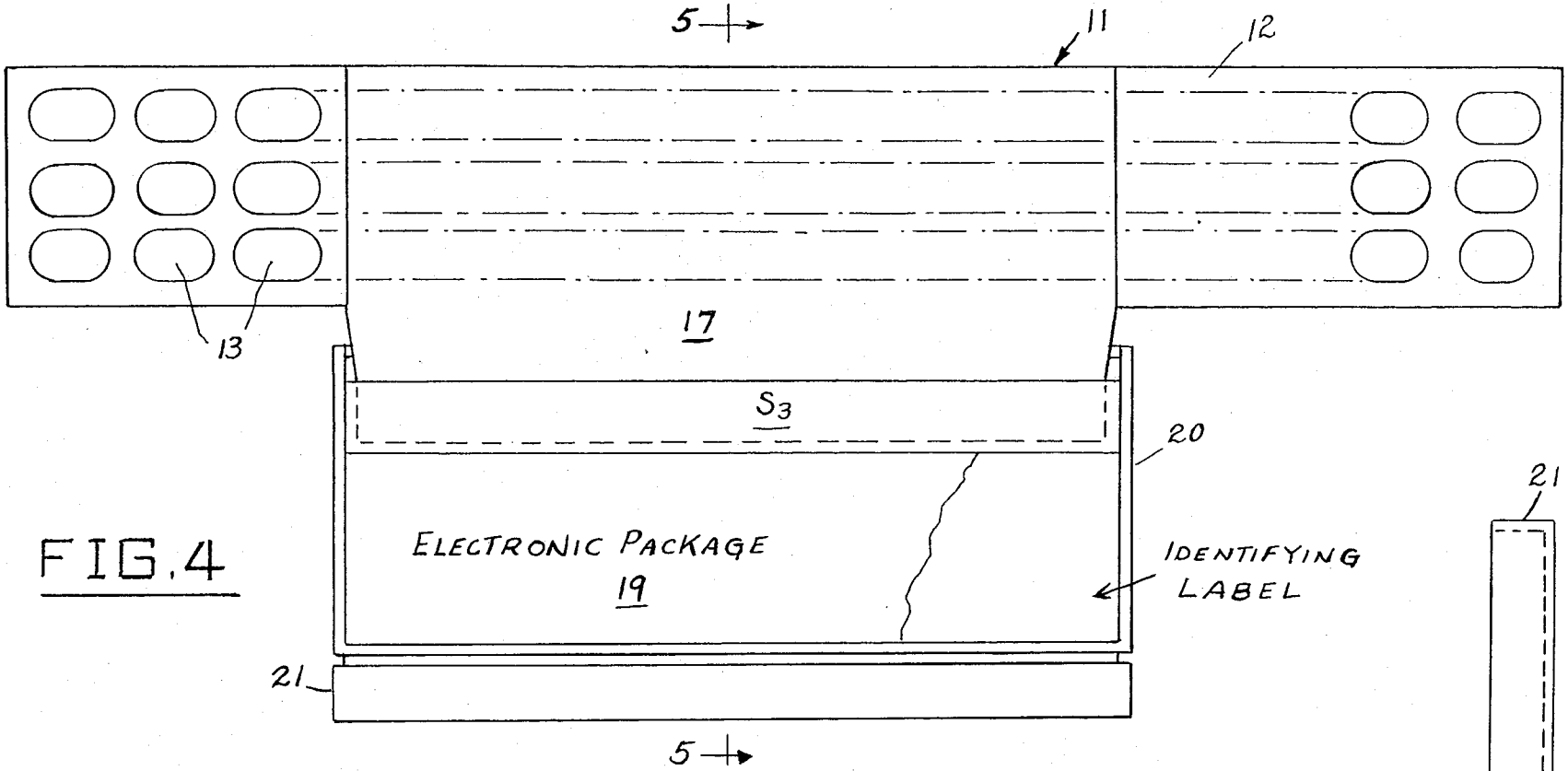
FIG. 4 is a top plan view of an open medication compliance monitoring device according to the present invention, including the blister pack of FIG. 1, the blister pack being shown in unfolded condition allowing a patient to remove a medication dose.
Figure 5:
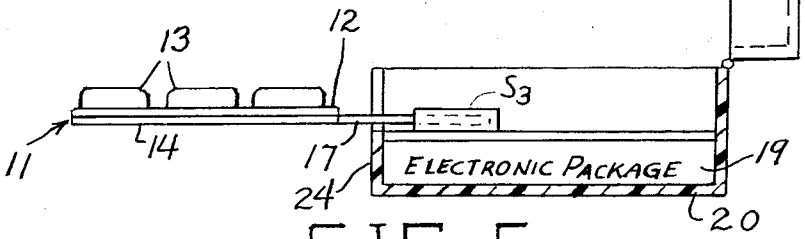
FIG. 5 is a transverse vertical cross-sectional view taken substantially on line 5—5 of FIG. 4.

The electronic memory device 19 is that portion of the apparatus that records the elapsed-time interval during which the conductive trace 18 behind each blister 13 is broken. The electronic circuitry is enclosed in a suitably formed rectangular plastic case 20 with a longitudinally hinged top cover 21, as shown in FIGS. 4 and 5. In the described specific embodiment, the case is 50 mm wide, 170 mm long, and 30 mm deep. The case 20 is detachably secured to the blister pack 11 by the interlocking frictional engagement of the tab 17 in a multi-contact female connector sleeve $S_3$ carried by the circuit board of the electronic package 19 adjacent the longitudinal side wall 24 of the case 20 opposite the hinge of cover 21, as shown in FIG. 5. The contacts of connector sleeve $S_3$ make contact with the respective contact terminals 23 associated with the conductive traces 18 and connects them to the electronic memory package 19.

The electronic memory circuitry keeps account of the elapsed time (from initialization) and at 15 minute intervals, evaluates the integrity of the conductive trace 18 behind each blister 13 in the blister pack. A single 12-bit memory word is assigned to each blister and stores the elapsed time data for that blister. While the conductive trace 18 behind the blister is intact, the circuitry updates the elapsed time information in the corresponding memory location at the end of each 15 minute interval. Once the trace 18 is broken, the circuitry no longer updates the elapsed time information. Thus, when the device is retrieved from the patient, the time information in each memory location represents the elapsed time interval during which the trace 18 was broken.

Figure 6:
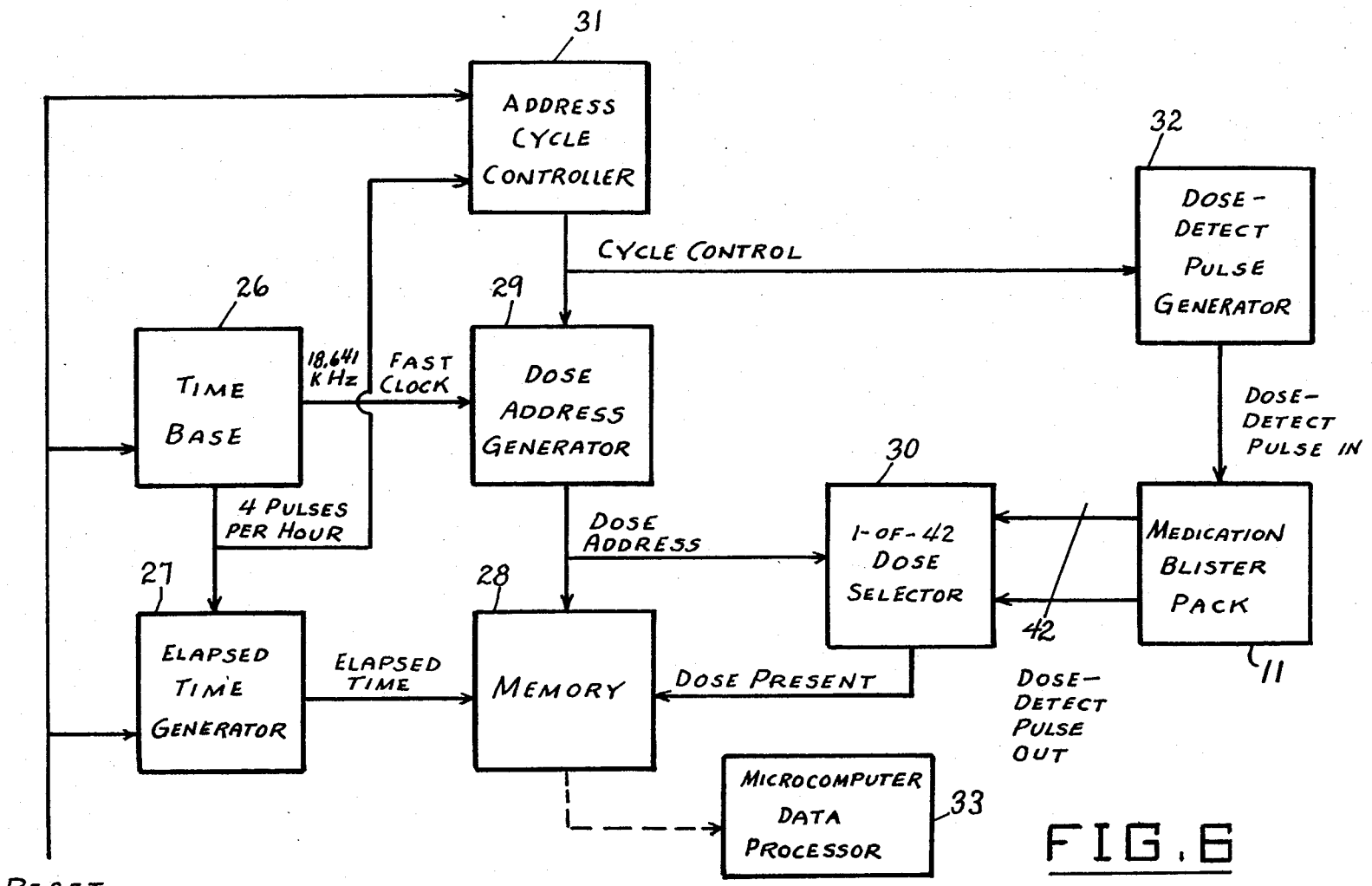
FIG. 6 is a functional block diagram of the electronic memory circuitry employed in a medication compliance monitoring device according to the present invention.

The electronic memory circuitry can be separated into eight functional blocks, as illustrated in FIG. 6. The Time Base 26 provides crystal-controlled timing signals to the other functional blocks, namely, an 18.641 KHz Fast Clock and a 4-pulse-per-hour timing signal. The Elapsed Time Generator 27 counts the pulses from the Time Base 26, and provides 12-bit binary elapsed time information to the Memory 28.

The Memory 28 provides a single 12-bit memory word for each blister 13 in the blister pack. If the dose is still present in a blister 13 when that blister and its corresponding memory location are addressed, the time from the Elapsed Time Generator 27 is updated in that memory location.

The Dose Address Generator 29 simultaneously provides an address to the Memory 28 and to the 1-of-42 Dose Selector 30. The Dose Address Generator 29 uses the Fast Clock signal from the Time Base 26 to cycle through each of the blisters and their corresponding memory locations. The Dose Address Generator 29 is allowed to cycle through the addresses once every 15 minutes by the Address Cycle Controller 31.

The 1-of-42 Dose Selector 30 uses the Dose Address to select a single dose in the matrix of conductive traces 18 in the blister pack backing 14. If the dose trace 18 is intact, the Dose-Detect Pulse passes through the selected trace 18 and signifies that the dose is present in that blister. The Dose-Detect Pulse is derived from the Dose-Detect Pulse Generator 32.

Figure 7A:
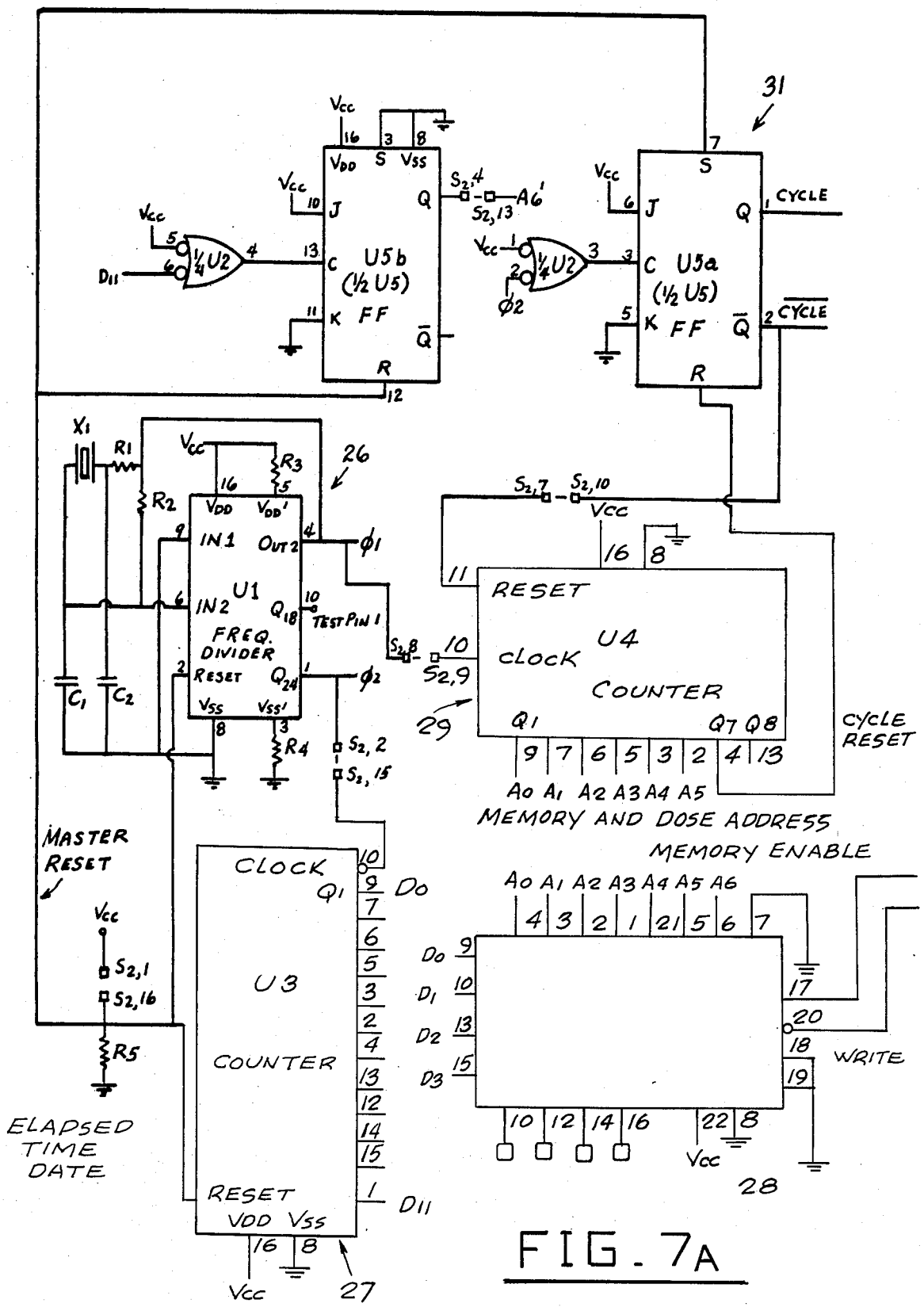
FIGS. 7A, 7B and 7C are segmental detailed wiring diagrams which, when placed side-by-side, substantially form the monitoring memory circuitry functionally represented in FIG. 6.
Figure 7B:
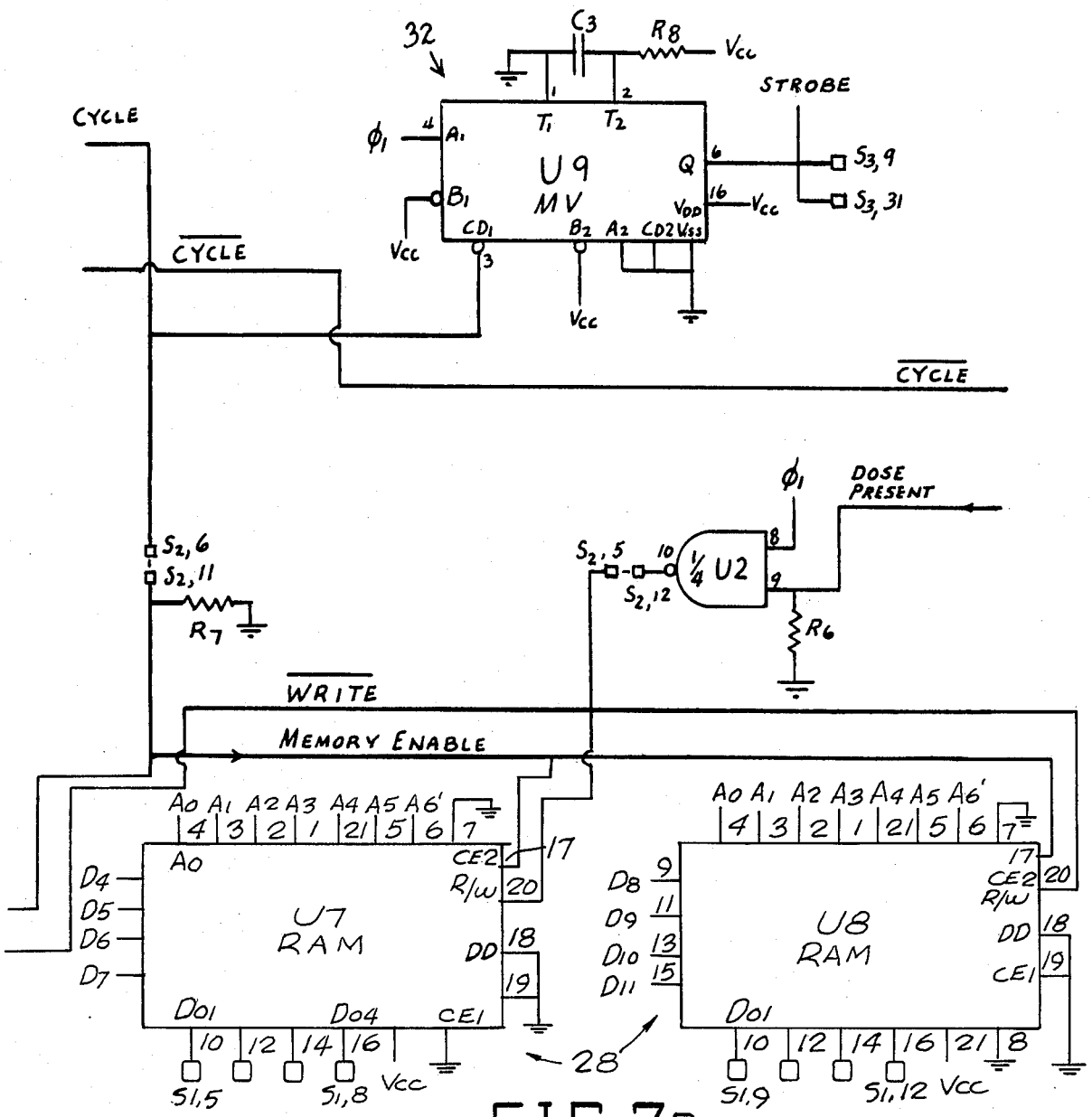
Figures 7C, 8:
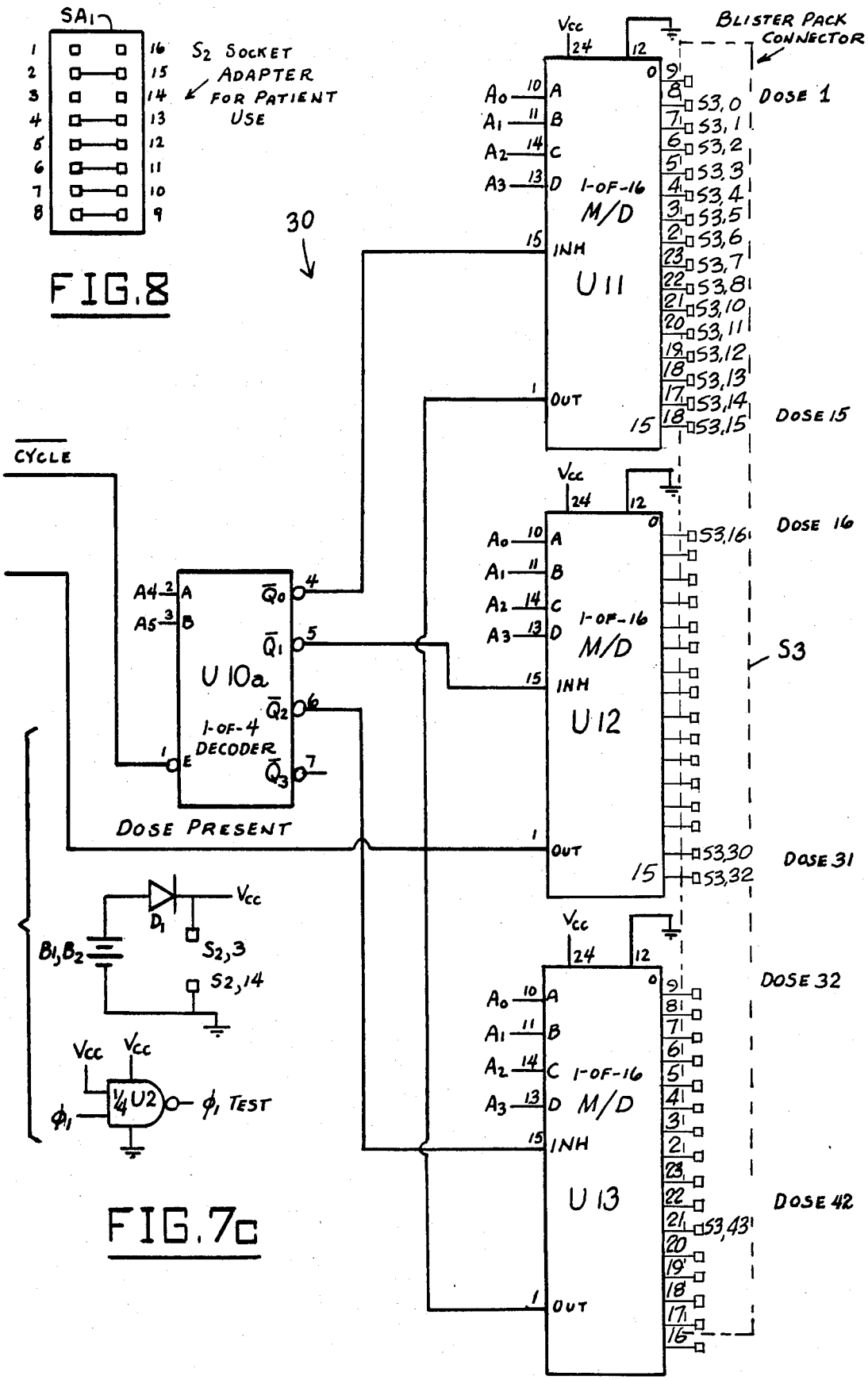
FIG. 8 diagrammatically shows an adapter for conditioning the monitoring memory circuitry for use by a patient.

Referring to FIGS. 7A, 7B and 7C, the following is a description of the electronic memory circuitry at the signal level:

Integrated circuit $U_1$ is a 24-stage oscillator/frequency divider that comprises the Time Base for the portable device (26). A precision 18.641 KHz crystal $X_1$, along with resistors $R_1$ and $R_2$, and capacitors $C_1$ and $C_2$, provide the timing for a conventional CMOS Pierce oscillator. The 18.641 KHz output of the oscillator is used as a Fast Clock signal $\phi_1$. The output of the twenty-fourth divider stage is a timing signal $\phi_2$, that provides 4 pulses per hour. The MASTER RESET signal (obtained by bridging the contacts $S_{2,1}$ and $S_{2,16}$ at a starting time) initializes the divider stages to zero. Resistors $R_3$ and $R_4$ help to minimize the power drain of the integrated circuit.

Integrated circuit $U_3$ forms the Elapsed Time Generator 27, and is a 12-stage binary counter that converts the pulses of signal $\phi_2$ into a 12-bit binary count of the elapsed time, $D_0$ through $D_{11}$ which are presented to the memory components (28) comprising integrated circuits $U_6$, $U_7$ and $U_8$. The MASTER RESET signal, above described, initializes the count to zero. Each negative-going transition of signal $\phi_2$ increments the count in $U_3$. The counter will count through 4096 counts, which represent 42.67 days at 4 counts per hour.

Integrated circuit $U_4$ forms the Dose Address Generator 29, and is another 12-stage binary counter that provides the $A_0$ to $A_5$ address signals that select each blister and its corresponding memory location. This counter is held in a reset state when $\overline{\text{CYCLE}}$ is asserted high. When $\overline{\text{CYCLE}}$ is held low, the counter counts the negative-going transitions of the $\phi_1$ clock signal, and cycles through the addresses 0 through 63, when $\overline{\text{CYCLE}}$ returns high.

Integrated circuit $U_9$ forms the Dose Detect Pulse Generator 32, and is a monostable multivibrator that provides a 10 microsecond STROBE pulse used to detect the presence of the conductive trace 18 behind each blister. $U_9$ is inactive while CYCLE is in a low state. When CYCLE is asserted high, $U_9$ generates a 10 microsecond STROBE pulse on each positive-going transition of $\phi_1$. This strobe pulse is simultaneously supplied to all of the conductive traces 18 in the blister pack 11 via connector contacts $S_{3,9}$ and $S_{3,31}$.

Integrated circuits $U_{10a}$, $U_{11}$, $U_{12}$ and $U_{13}$ constitute the circuitry forming the 1-of-42 Dose Selector block 32, for selecting the conductive trace 18 corresponding to the current address. Integrated circuit $U_{10a}$ is a bank selector that enables the proper bank of blisters (via $U_{11}$, $U_{12}$ or $U_{13}$) according to address lines $A_4$ and $A_5$. Address lines $A_0$ to $A_3$ then further select the proper individual trace within that bank, such that for a given address only one analog switch gate in $U_{11}$, $U_{12}$ or $U_{13}$ is enabled. The output lines from $U_{11}$, $U_{12}$ and $U_{13}$ are wire-OR'ed together to constitute a DOSE PRESENT signal. If the conductive trace corresponding to the current address is intact, the STROBE pulse from $U_9$ feeds through the blister pack trace and the enabled analog switch gate and becomes a DOSE PRESENT pulse used to create a memory $\overline{\text{WRITE}}$ pulse.

Integrated circuits $U_6$, $U_7$ and $U_8$, constituting the memory stage 28, are each 256×4-bit CMOS static random-access memories (RAM's). They are configured to provide a 256×12-bit RAM for storing the 12-bit elapsed time data for each blister. Address lines $A_0$ to $A_5$ from $U_4$ and address $A_6'$ from $U_{5b}$ select the proper memory address, and the twelve elapsed-time lines from $U_3$ are applied to the twelve data lines of the RAM. The MEMORY ENABLE signal places the RAM into the write mode. The DOSE PRESENT signal is logically AND'ed with the $\phi_1$ clock signal to write the time information on the data lines into the memory location specified by the address lines. The high-to-low transition of $\overline{\text{WRITE}}$ latches the address from the address lines, and the low-to-high transition of $\overline{\text{WRITE}}$ writes the time data into the specified memory location.

Integrated circuit $U_{5b}$ is a memory bank selector that is used to extend the effective data gathering period to 85.33 days. During the first 42.67 day period, address line $A_{6'}$ remains in a low state and elapsed time data is stored in memory locations 1 through 42. When the elapsed time count in $U_3$ wraps around from 4095 to 0000, the high-to-low transition of $D_{11}$ changes the $A_{6'}$ output of $U_{5b}$ to a high state. Elapsed time data for the subsequent 42.67 day period is then written into memory locations 65 through 106.

A typical write cycle occurs as follows: The high-to-low transition of $\phi_2$ initiates the write cycle by incrementing the count in $U_3$ and setting flip-flop $U_5$. As flip-flop $U_5$ is set, counter $U_4$ is released from its reset state. During the subsequent low state of $\phi_1$, the first address is presented to the Memory and to the 1-of-42 Dose Selector 30. If the DOSE PRESENT signal is true, $\overline{\text{WRITE}}$ is forced low on the low-to-high transition of $\phi_1$, and latches the address into the Memory. The subsequent high-to-low transition of the DOSE PRESENT pulse writes the time data into that memory location, and increments counter $U_4$ to begin the cycle for the next address. When the address count reaches 64, CYCLE RESET goes high, which resets flip-flop $U_4$ and terminates the write cycle.

The following Table identifies parts employed with the electronic circuit embodiment illustrated in FIGS. 7A, 7B and 7C:

TABLE I

| Part | Part No. | Description | Manufacturer |
|---|---|---|---|
| $U_1$ | MC14521B | IC, CMOS 24-Stage Frequency Divider | Motorola |

TABLE I-continued

| Part | Part No. | Description | Manufacturer |
|---|---|---|---|
| $U_2$ | MC14011B | IC, CMOS Quad 2-Input NAND Gate | Motorola |
| $U_3$, $U_4$ | MC14040B | IC, CMOS, 12-Stage Binary Counter | Motorola |
| $U_{5a}$, $U_{5b}$ | MC14027B | IC, CMOS, Dual J-K Flip-Flop | Motorola |
| $U_6$, $U_7$, $U_8$ | MCM5101 | IC, CMOS 256 × 4 Bit RAM | Motorola |
| $U_9$ | MC14528B | IC, CMOS, Dual Monostable Multivibrator | Motorola |
| $U_{10a}$ | MC14556B | IC, CMOS, Dual Binary 1-of-4 Decoder (only ½ used) | Motorola |
| $U_{11}$, $U_{12}$, $U_{13}$ | IC, CMOS, 1-of-16 | RCA Multiplexor/Demultiplexor | |
| $D_1$ | 1N4001 | Diode, Rectifier, Silicon | Motorola |
| X1 | CX-1V-18.641 KHz (A) V194 | Crystal, 18.641 KHz, ±0.003% Calibration | Statek |
| $B_1$, $B_2$ | CR2430 | Battery, 3V,200 mAH | General Electric |
| $C_1$ | 10TS-V50 | Capacitor, Ceramic, 5pf 1000WDVC, 10% | Sprague |
| $C_2$ | 10TS-Q10 | Capacitor, Ceramic, 10pf 1000WVDC, 10% | Sprague |
| $C_3$ | 10TS-T10 | Capacitor, Ceramic, 100pf 1000WVDC, 10% | Sprague |
| $R_1$ | RCR07 | Resistor, 470K ohms | TRW IRC |
| $R_2$ | RCR07 | Resistor, 10 M | TRW IRC |
| $R_3$, $R_4$ | RCR07 | Resistor, 12 K | TRW IRC |
| $R_5$ | RCR07 | Resistor, 100 K | TRW IRC |
| $R_6$ | RCR07 | Resistor, 10 K | TRW IRC |
| $R_7$ | RCR07 | Resistor, 100 K | TRW IRC |
| $R_8$ | RCR07 | Resistor, 82 K | TRW IRC |
| SA1 | 702-3728-01-04-00 | Adapter, Socket, IC, Components, 16-pin | Cambion |
| $S_1$, $S_2$ | 703-5316-01-04-12 | Socket, IC, 16-pin, Low Profile, Tin Contact | Cambion |
| $S_3$ | | Socket, 44-contact, Blister Pack | |

FIG. 8 diagrammatically illustrates the conventional 16-pin socket adapter SA1, with jumpers connecting pins 2-15, 4-13, 5-12, 6-11, 7-10 and 8-9. This adapter is engageable in a conventional socket $S_2$, not shown, whose contacts are correspondingly illustrated in FIGS. 7A and 7B, to condition the electronic circuitry for patient usage. The sockets $S_1$ and $S_3$ have their contacts indicated in FIGS. 7A, 7B and 7C. The socket adapter SA1 is plugged into socket $S_2$ when the device is issued to the patient. During the patient's return visit the socket adapter $SA_1$ is removed and "umbilical cords" are plugged into sockets $S_2$ and $S_1$ to extract the time data. When $SA_1$ is plugged into socket $S_2$, the circuit control lines are configured for writing time data into the memory. To extract the time data from the memory, $SA_1$ is removed and two cables from the computer are plugged into sockets $S_1$ and $S_2$. The computer manipulates the control lines on socket $S_2$ and reads the data from the memory through socket $S_1$.

As above mentioned, during the patient's return visit the memory circuit is interfaced to the microcomputer data processor, shown generally at 33 in FIG. 6. The microcomputer data processor 33 is of conventional construction and is programmed to perform the following functions:

1. It acquires the raw medication compliance data from the electronic memory circuit.

2. It stores the raw medication compliance data in a memory system for subsequent analysis.

3. It processes the raw medication compliance data into a variety of formats that are furnished to the patient's health provider.

4. It transmits the medication compliance data to other computing centers for analysis.

By employing suitable computer software, the microcomputer data processor 33 may furnish a printout showing the raw elapsed time data acquired from the electronic memory circuit.

The raw elapsed time data may also be processed into a variety of formats that illustrate the actual time and date of medication removal either directly or in a derived format (e.g., lists, charts, graphs, histograms, etc.).

An actual commercially available microcomputer system or processor which can be used to perform the data acquisition and processing consists of the following components:

1. Apple II Plus microcomputer with 64K bytes of RAM, Pascal language system, and Serial I/O interfaces.

2. Dual Apple II 5-¼ inch flexible diskette drives.

3. Beehive DM1A Display/Keyboard terminal.

4. Integral Data Systems 460G dot-matrix serial printer.

5. Special programmable parallel I/O interface using a John Bell 6552 Apple II Interface.

Various important enhancements to the above-described medication compliance monitoring system are foreseen and should be comprehended within the range of equivalents of features of the present invention, such as:

1. The use of a hybrid integrated circuit or custom large-scale integrated circuit to reduce the size and weight of the electronic memory circuit, and perhaps allow other capabilities to be added.

2. Different blister pack configurations, including additional or fewer blisters, blisters of different dimensions, and the like.

3. Different time resolution, including longer or shorter time intervals between dose detection cycles.

4. Different maximum elapsed-time capacity, including longer or shorter elapsed-time capacity.

5. The inclusion of a built-in visual reminder and/or audible alarm to alert the patient that it is time to take his or her medication.

While a specific embodiment of an improved medication compliance monitoring device has been disclosed in the foregoing description, it will be understood that various modifications within the scope of the invention may occur to those skilled in the art. Therefore it is intended that adaptations and modifications should and are intended to be comprehended within the meaning and range of equivalents of the disclosed embodiment.

What is claimed is:

1. A medication compliance monitoring device, comprising:

a medication package including an array of medication compartments each being designed to carry a unit close of medication therein and each being yieldable for medication removal, a frangible backing sheet closing all of of said medication compartments such that medication can be removed from each said compartment by pushing the yieldable compartments to force the medication through the frangible backing sheet by rupturing the backing sheet adjacent the compartment being pushed; and an electronic monitoring circuit including a plurality of conductive traces disposed on said backing sheet, a unique trace being disposed adjacent each said compartment such that the rupture of said frangible sheet during removal of a unit dose of medication from a compartment will cause rupture of one of said conductive traces, detection means for addressing each said unique trace periodically at a constant predetermined time interval over a predetermined extended period of time and detecting whether each such trace is ruptured or intact, memory means for storing the time that the rupture of each unique trace is first detected by said detection means, and connecting means for permitting said memory means to be connected to a microcomputer, whereby said microcomputer can extract data from said memory means for processing and display.

2. The medication compliance monitoring device of claim 1, wherein said array of medication compartments comprises a front sheet of yieldable material formed with an array of blisters defining the respective medication compartments.

3. The medication compliance monitoring device of claim 2, and wherein said blisters are arranged in a plurality of rows columns.

4. The medication compliance monitoring device of claim 2, wherein said blisters are arranged in a plurality of rows and columns defining said array and wherein the package is foldable on at least one transverse fold line of said array.

5. The medication compliance monitoring device of claim 2, and wherein said blisters define a substantially rectangular array.

6. The medication compliance monitoring device of claim 1, wherein each said unique conductive trace on the frangible backing sheet extends substantially in a saw-tooth pattern across a medication compartment.

7. The medication compliance monitoring device of claim 1, wherein said backing sheet includes a connector tab provided wih respective terminals connected to said conductive traces.

8. The medication compliance monitoring device of claim 1, wherein said array of medication compartments comprises an elongated front sheet of yieldable material formed with an array of blisters forming the compartments and comprising rows and columns of said compartments, said frangible backing sheet being substantially coextensive with and being secured to said front sheet, said conductive traces extending substantially in saw-tooth patterns across the compartments.

9. The medication compliance monitoring device of claim 8, wherein the package is transversely foldable to define a plurality of panels, and wherein said backing sheet is provided with a connector tab extending longitudinally along one of said panels and having respective terminals connected to said conductive traces.

10. The medication compliance monitoring device of claim 1, further including manually operable control means to alternately configure said electronic monitoring circuit for data acquisition and for data extraction.

11. The medication compliance monitoring device of claim 1, wherein said conductive traces on said frangible backing sheet extend substantially diagonally across the medication compartments.

12. The medication compliance monitoring device of claim 1, further including a protective housing, and an electronic circuit board disposed within said housing, said detecting means and memory means being disposed on said circuit board, wherein said circuit board includes cooperating multiconductor detachable connector means for electrically connecting said detecting means and memory means with said conductive traces, and wherein said medication package is receivable within said protective housing.

13. The medication compliance monitoring device of claim 1, wherein said backing sheet includes a connector tab provided with respective male terminals connected to said conductive traces, and wherein said cooperating connecting means comprise a female multiterminal connector on said circuit board, said male connector tab being grippingly but detachably receivable in said female multi-termal connector.

14. The medication compliance monitoring device of claim 13, wherein said array of medication compartments comprises an elongated front sheet of yieldable material formed with an array of blisters forming the compartments, said frangible backing sheet being substantially coextensive with and being secured to said front sheet, said traces extending across the blisters, and wherein said package includes at least one panel and said male connector tab is located at the side margin of said panel.

15. The medication compliance monitoring device of claim 13, wherein said array of medication compartments comprises an elongated front sheet of yieldable material formed with an array of blisters forming the compartments, said frangible backing sheet being substantially coextensive with and being secured to said front sheet, said traces extending across the blisters, and wherein said package is transversely foldable to define a plurality of panels and is receivable in said protective housing in the folded condition, said male connector tab being located at the side margin of one of said panels.

16. The medication compliance monitoring device of claim 15, and wherein said package is transversely foldable at two locations to define three respective panels, said male connector tab being located at the side margin of the central panel.

17. The medication compliance monitoring device of claim 1 having a size and weight suitable for personal use.

18. A method of monitoring medication compliance, comprising the steps of:

supplying to a patient whose medication compliance is to be monitored a medication package having an array of medication compartments which are yieldable for medication removal, a plurality of said compartments having a medication in unit dosage form therein, the package further including a frangible backing sheet closing all of of said medication compartments such that medication can be removed from each said compartment by pushing the yieldable compartments to force the medication through the frangible backing sheet by rupturing the backing sheet adjacent the compartment being pushed; and a plurality of conductive traces disposed on said backing sheet, a unique trace being disposed adjacent each said compartment such that the rupture of said frangible sheet during removal of a unit dose of medication from a compartment will cause rupture of one of said conductive traces;

addressing each individual trace periodically at a constant predetermined time interval over a predetermined extended period of time to detect whether each such trace is intact or ruptured;

storing the time that the rupture of each unique trace is first detected; and subsequently retrieving the stored time data comprising the respective detected times of rupture of the addressed individual traces.

* * * * *

UNITED STATES PATENT AND TRADEMARK OFFICE

CERTIFICATE OF CORRECTION

PATENT NO. : 4,616,316

DATED : October 7, 1986

INVENTOR(S) : Hanpeter et al

It is certified that error appears in the above-identified patent and that said Letters Patent is hereby corrected as shown below:

Change the title of the invention as shown on the face of the patent under "[54]" and at the top of column 1 to read:
--MEDICATION COMPLIANCE MONITORING DEVICE HAVING CONDUCTIVE TRACES UPON A FRANGIBLE BACKING OF A MEDICATION COMPARTMENT AND METHOD OF MONITORING MEDICATION COMPLIANCE USING THE SAME.--

Column 9, line 65: delete "and";
line 66: add --and-- after "rows";

Column 10, line 37: change "the" to --said--;
line 49: change "1" to --12--.

Signed and Sealed this

Seventeenth Day of February, 1987

*Attest:*

DONALD J. QUIGG

*Attesting Officer*

*Commissioner of Patents and Trademarks*